United States Patent [19]

Wilkins

[11] 4,453,386

[45] Jun. 12, 1984

[54] HIGH CAPACITY MAT CLEANING MACHINE

[76] Inventor: Ronald W. Wilkins, 3215 Avenue K, Bay City, Tex. 77414

[21] Appl. No.: 380,692

[22] Filed: May 21, 1982

[51] Int. Cl.[3] ..... D06B 1/02

[52] U.S. Cl. ..... 68/19.1; 68/196; 68/205 R

[58] Field of Search ..... 68/205 R, 19.1, 22 R, 68/196; 134/64 R, 64 P, 122 R, 122 P; 198/817

[56] References Cited

U.S. PATENT DOCUMENTS

| | | | |
|---|---|---|---|
| 2,697,341 | 12/1954 | Thomas | 68/196 X |
| 2,787,153 | 4/1957 | Ketchum et al. | 68/205 R |
| 3,123,994 | 3/1964 | Brown et al. | 68/205 R |
| 3,253,432 | 5/1966 | Moore et al. | 68/205 R X |
| 3,431,921 | 3/1969 | Pesek | 198/817 X |
| 3,779,367 | 12/1973 | Hope et al. | 15/3 X |
| 4,083,206 | 4/1978 | Lemon et al. | 68/205 R X |
| 4,176,531 | 12/1979 | Fleissner | 68/19.1 X |
| 4,180,994 | 1/1980 | Lemon et al. | 68/205 R X |

*Primary Examiner*—Philip R. Coe

*Attorney, Agent, or Firm*—Arnold, White & Durkee

[57] ABSTRACT

In accordance with an illustrative embodiment of the present invention, a high capacity machine for washing industrial mats or rugs and the like comprises a generally rectangular tank divided by internal partitions into two wash sections and two rinse sections. An endless belt conveyor system attached to the top of the tank serves to move the mats over the tank sections with the nap of the mats facing down. Transverse header pipes in the tank sections are provided with rows of nozzles that form high velocity sprays of liquid which impinge against the nap to effect the scrubbing and rinsing action. The nozzles are directed at angles of 35° forward and rearward with respect to the plane of the mat, with the nozzles which provide the detergent sprays having orifices that form flat or knife-like sprays to effect a deep cleaning of the nap, while the nozzles which provide the rinse sprays have orifices that effect diverging sprays to flush the detergent and particulate matter out of the nap.

23 Claims, 6 Drawing Figures

HIGH CAPACITY MAT CLEANING MACHINE

FIELD OF THE INVENTION

This invention relates generally to a machine for washing mats and industrial rugs and the like, and particularly to a new and improved high capacity mat washing machine that employs liquid sprays directed at an angle against the nap of the mat to wash and rinse the same as the mat is conveyed through the machine.

BACKGROUND OF THE INVENTION

Various types of machines have been proposed for use in cleaning industrial rugs or mats. Such mats are generally rectangular (i.e., 3×5 feet) in shape, and have the nap on one side and a rubber or vinyl backing on the other. The mat is conveyed through the machine by an endless belt drive arrangement, and the nap is subjected to a scrubbing action by brushes or to high velocity liquid sprays to effect cleaning.

The machines that employ brushes are not considered to be particularly effective in providing the deep cleaning action which is highly desirable. The brushes require constant adjustment due to wear and to variations in nap construction and manufacture. Moreover a repeated brushing action tends to wear the nap prematurely. An example of a prior machine that uses a liquid spray is disclosed in U.S. Pat. No. 3,779,367 issued Dec. 18, 1973. However this apparatus is considered to have a number of shortcomings. For example, the sprays emanate from a single row of nozzles that are directed vertically upward. Such an arrangement drives particulate matter up into the nap where sand and dirt will cut the fibers of the rug, and obviously does not provide a good cleaning action. Perhaps even more significant is the fact that a direct upward spray under high pressure will tend to destroy the heat-set twist of the nap fibers, and thereby seriously degrade the mat. The patent also discloses the use of but a single tank without any rinse. Where thorough rinsing is not provided, detergent remaining in the mat acts somewhat like a magnet and attracts dirt particles. Therefore the patented device is not considered to provide an effective cleaning system, particularly where high capacity is desirable.

An object of the present invention is to provide a new and improved mat cleaning apparatus of the type that employs liquid sprays.

Another object of the present invention is to provide a new and improved mat washing apparatus that employs high velocity liquid sprays that are directed at a particular angle against the sides of the nap to provide an effective washing and rinsing action.

Yet another object of the present invention is to provide a new and improved mat washing machine that uses liquid sprays to effect cleaning and which has a series of separate wash and rinse sections to promote effective cleaning of the mat.

Still another object of the present invention is to provide a mat washing machine having a new and improved internally driven system for conveying mats therethrough without drag to provide for higher capacity operation than prior devices.

Another object of the present invention is to provide a new and improved mat washing machine that can be readily and easily maintained at minimum expense to the user.

A general object of the present invention is to provide a new and improved industrial mat washing machine that has a substantially higher operating capacity than prior machines of its general type. Detergent and rinse water are recirculated and rinsed so that very little make-up process water is required in operation of the machine.

SUMMARY OF THE INVENTION

These and other objects are attained in accordance with the concepts of the present invention through the provision of apparatus for use in cleaning mats or the like of the type having the nap on one side and comprising a tank structure with conveyor means for moving a mat along the top of the tank with the nap facing down. The tank structure is divided by internal partitions into a plurality of separate sections or compartments, and transversely arranged headers are mounted near the top of each of the tank sections. Each header is provided with an array of spaced-apart spray nozzles that direct sprays of liquid upwardly at an angle with respect to the direction of travel of the mat so that the liquid impinges against the sides of the nap. The first two headers, which are associated with the first and second detergent tanks, are provided with nozzles having orifices that forms substantially flat or knife-type sprays with some of the nozzles being pointed upward and forward while others are pointed upward and rearward. The angle of impingement of the sprays with respect to the plane of the mat is in the range of from 30° to 40°, and preferably is 35°. These nozzles provide sprays of washing liquid or detergent which turn the nap as the mat passes thereover to provide a thorough cleaning action. Particulate matter and washing liquid are permitted to fall into the first and second detergent tank section where a substantial amount of the particulates can settle out. Additional headers are positioned near the top of the first and final rinse tank sections and are supplied with water which is directed upwardly at an angle against the nap to provide a rinsing action. The nozzles on these headers have orifices with considerably more opening angle to form diverging sprays at a lesser operating pressure to flush out the detergent and remove additional particulate sand or other impurities that still may be in the nap of the rug or mat. The direction of these rinse sprays still is preferably 35° forward and rearward.

As a mat enters the machine it is conveyed downwardly somewhat with respect to the first detergent tank to enhance water concentration, and as it leaves the final rinse tank it is elevated slightly by longitudinally extending and upwardly inclined picks to aid in water removal. Then the mat enters in between a pair of extract rollers at the exit end of the conveyor means. One of these rollers may be made of plated steel while the other is made of the hard rubber, and the rollers are pressed together by suitable pneumatic cylinder means to provide a squeezing action. If desired, upper and lower sets of air nozzles may be positioned immediately preceding the extract rollers to remove additional moisture from the mat. Additional spray headers having nozzles directed forwardly are positioned above the mat to wash and rinse the back sides thereof.

The conveyor means includes upper and lower endless belt mechanisms that pass over drive sprockets mounted on transverse shafts. The upper and lower belt mechanisms are driven by a common motor and gear box, and the sprocket arrangement provides an internal drive that is reliable and smooth and lends itself to high capacity operation. A plurality of cables are run the length of the lower conveyor table to the sides of the belts to prevent the edges or corners of a mat from becoming jammed or locked up in the machine. The bearings and water seals on the transverse shafts are accessible and can be removed from the outside to enable easy maintenance of the machine. The top cover of the machine is made of a sheet of transparent material which permits the operator to continuously view the progress of a mat passing through the conveyor means, as well as spray nozzle operation.

Slotted filter pipes extending into each tank section are connected to the inlet of pumps which feed the water under pressure to sand separators. The sand separators function is to remove any small size solid particles that remain in the water. From the sand separators, the water is returned to the wash and rinse headers for recycling through the machine. Detergent is injected into the detergent tanks by a suitable means which maintains a desired ph level in the system.

Thus it can be seen that a very thorough cleaning and rinsing action is provided in accordance with the present invention which lends itself to high capacity mat washing operations. The machine is very reliable and relatively maintenance-free and easy to operate.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DESCRIPTION OF A PREFERRED EMBODIMENT

Figure 1:
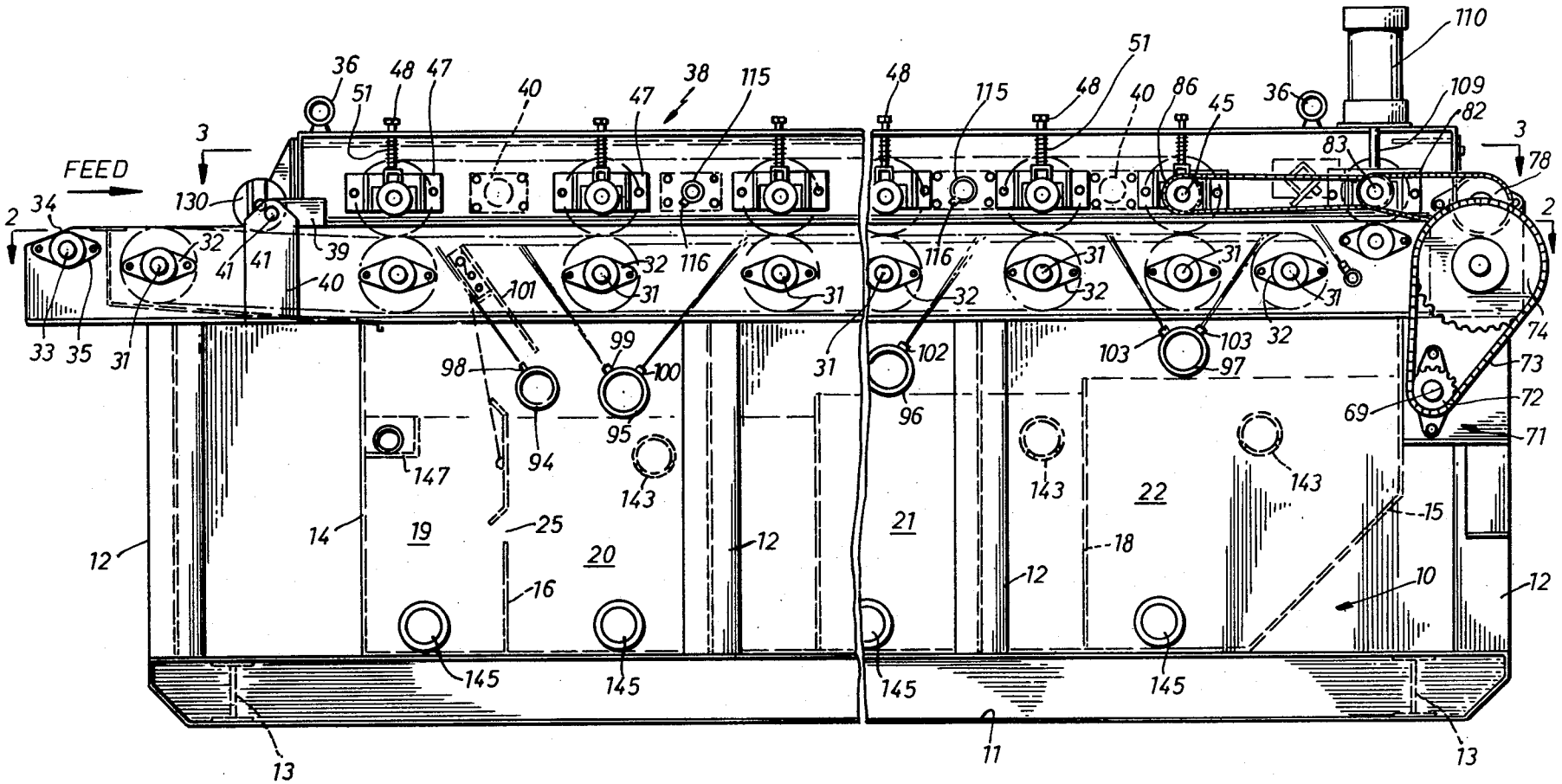
FIG. 1 is a side view of a mat washing apparatus constructed in accordance with the present invention.

Referring initially to FIG. 1, a mat cleaning machine that is constructed in accordance with the present invention includes an assembly of four tanks indicated generally at 10 which is formed inside of a frame made of suitable structural members such as I-beams. The frame 10 includes bottom runners or skids 11 welded to several uprights 12 with the front and rear ends of the runners 11 being joined by transverse beams 13. The side and bottom walls of the tank as well as the end walls 14 and 15 may be constructed of sheet metal, as are the transverse partitions 16, 17 and 18 which divide the tank assembly internally into four sections. The first two sections 19 and 20 are detergent sections, while the last two sections 21 and 22 are rinse sections. The transverse partition 16 that separates the two wash sections 19, 20 has an open area 25 therein in order to join these two sections together for sediment settling. The partitions 18, 17 and 16 have progressively diminishing heights so that feed water supplied to the final rinse section 22 flows over into the section 21 and then into the detergent sections 20 and 19. A weir box 147 (FIG. 6) enables process water to empty into a drain line.

L-shaped beams 26 are welded to the upper ends of the uprights 12 to provide elongated brackets extending along the upper side edges of the tank 10. A feed pan 27 extends between the front end portion of the brackets 26 and has a downwardly and rearwardly sloping bottom surface to provide drainage of liquid into the first detergent tank section 19. The vertical portion 30 of the side brackets 26 have a series of longitudinally spaced openings formed therein which receive the ends of a plurality of transversely extending shafts 31 that are included in the mat conveyor system to be described in detail herebelow. The ends of the shafts 31 are mounted in bearing assemblies 32 including water seals which are bolted to the outside of the bracket 26 in a suitable manner so as to be accessible from the outside for easy maintenance. The shaft 33 of the feed roller 34 also is mounted in bearings 35 at the entrance end of the machine.

Figure 5:
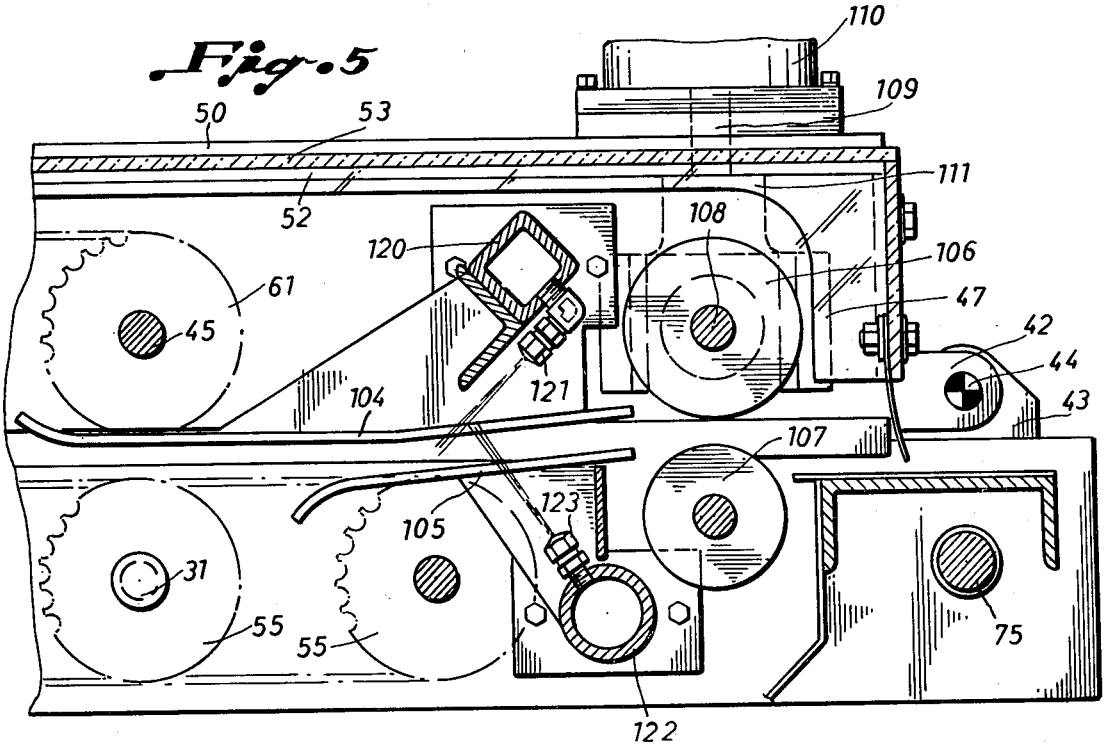
FIG. 5 is a fragmentary cross-sectional view taken along lines 5—5 of FIG. 4 to illustrate additional details of the exit end of the mat washing machine.

An upper conveyor framework 38 includes inverted L-shaped side members 37 joined together by spacer tubes 40 having end flanges that are bolted to the inner walls of the members 39. The framework 38 is removably mounted on the upper side of the lower conveyor framework by suitable means such as brackets 39 and 40 that are joined by removable pins 41 as shown in FIG. 1, and by additional brackets 42, 43 that are joined by pins 44 at the exit end of the machine as shown in FIG. 5. Of course the pins at either end of the machine can be removed to enable the upper conveyor bed to be tilted upwardly by suitable lifting eyes 36 for repair and maintenance. A series of longitudinally spaced, vertically elongated openings are formed in each of the members 37 to receive the ends of a plurality of transverse shafts 45 which are sealingly mounted in vertically movable bearing blocks 46. Each bearing block 46 is mounted in a slide bracket 47 which is bolted to the outside of the side members 37 and thus may be readily removed for purposes of maintenance. Guide bolts 48 which extend through apertures in the horizontal portion 50 of each of the frame members 37 have their lower end threaded into the respective bearing blocks 46 and are each surrounded by a compressed coil spring which biases the bearing block and thus the end of the shaft downwardly toward the companion shaft on the lower conveyor framework. As shown in FIG. 5, the upper portion 50 of each of the side members 37 extends inwardly of the vertical portion thereof, and together with an inwardly extending flange 52 welded therebelow provides a track in which the side edge of a transparent sheet of rigid plastic or other suitable material 53 is received which provides the top cover of the machine. The transparent plastic top sheet enables the operator to actually view the progress of a mat as it goes through the machine, and to detect any plugging of the nozzles which might impair machine operation. Of course the top can be readily removed to provide access to the conveyor assembly.

Figure 2:
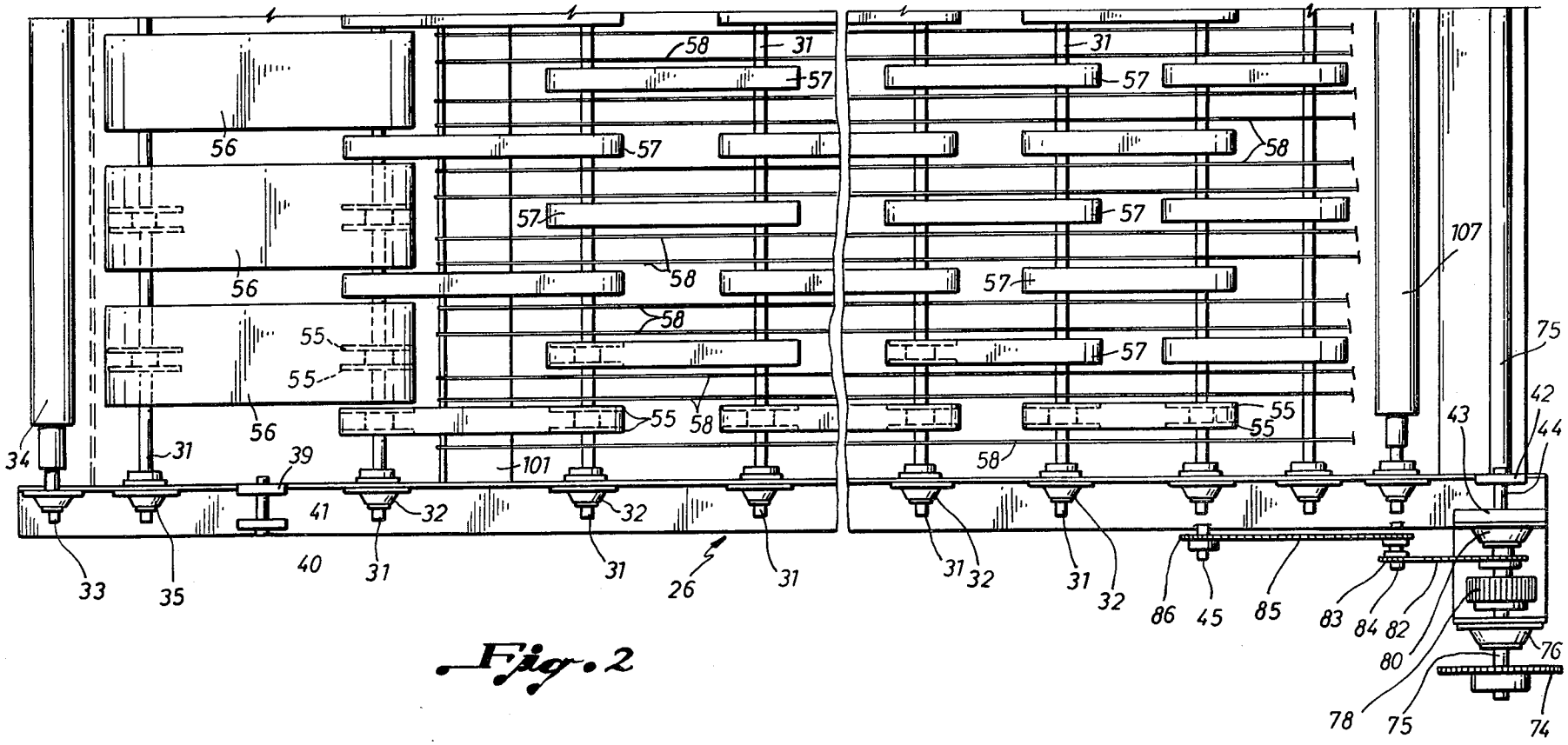
FIG. 2 is a partial view taken along sides 2—2 in FIG. 1 and showing the staggered array of endless belts that form the lower drive of the conveyor means.

As shown in FIG. 2, which is a fragmentary view of one side of the lower conveyor belt assembly, the lower shafts 31 each carry a plurality of sprocket wheels 55 mounted in pairs and laterally spaced along the length of each shaft. The sprocket wheels 55 are each keys to the shaft so as to rotate therewith. The first two of the shafts 31 nearest the entry end of the machine mount sprocket wheels around which relatively wide endless belt assemblies 56 are extended. Each of the belts 56 is formed of a series of individual plastic plates that are linked together by ears through which pins are extended. A rib centrally located on the backside of each plate engages in the space between sprocket wheels 55 to maintain longitudinal alignment, and the teeth of the sprocket wheels mesh with the ears to provide a driving connection. The relatively wide belt assemblies 56 provide a means for feeding a mat into the entrance end of the machine, and the second shaft 31 is positioned somewhat lower than the first one so that the mat is fed slightly downward to enhance water containment.

The third and subsequent ones of the shafts 31 also are provided with laterally spaced pairs of sprocket wheels 55 around which relatively narrow link belt assemblies 57 are extended in a staggered array as shown in the drawings. Since the shafts, sprocket wheels and individual link belts are all connected together in driving relation, it will be appreciated that only one shaft need be driven which will cause all of the other shafts and the link belts to be driven.

A plurality of cables or rods 58 made preferably of stainless steel extend parallel to the belts 57 and to each other as shown in FIG. 2. The cables 57, which lie in substantially the same plane as the upper runs of the belts 57 function to support the edges and corners of a mat passing through the conveyor system to prevent them from catching or hanging. The respective ends of the cables are attached to interior walls of the end tanks by turnbuckles or the like (not shown) to maintain them under suitable tension.

Figure 3:
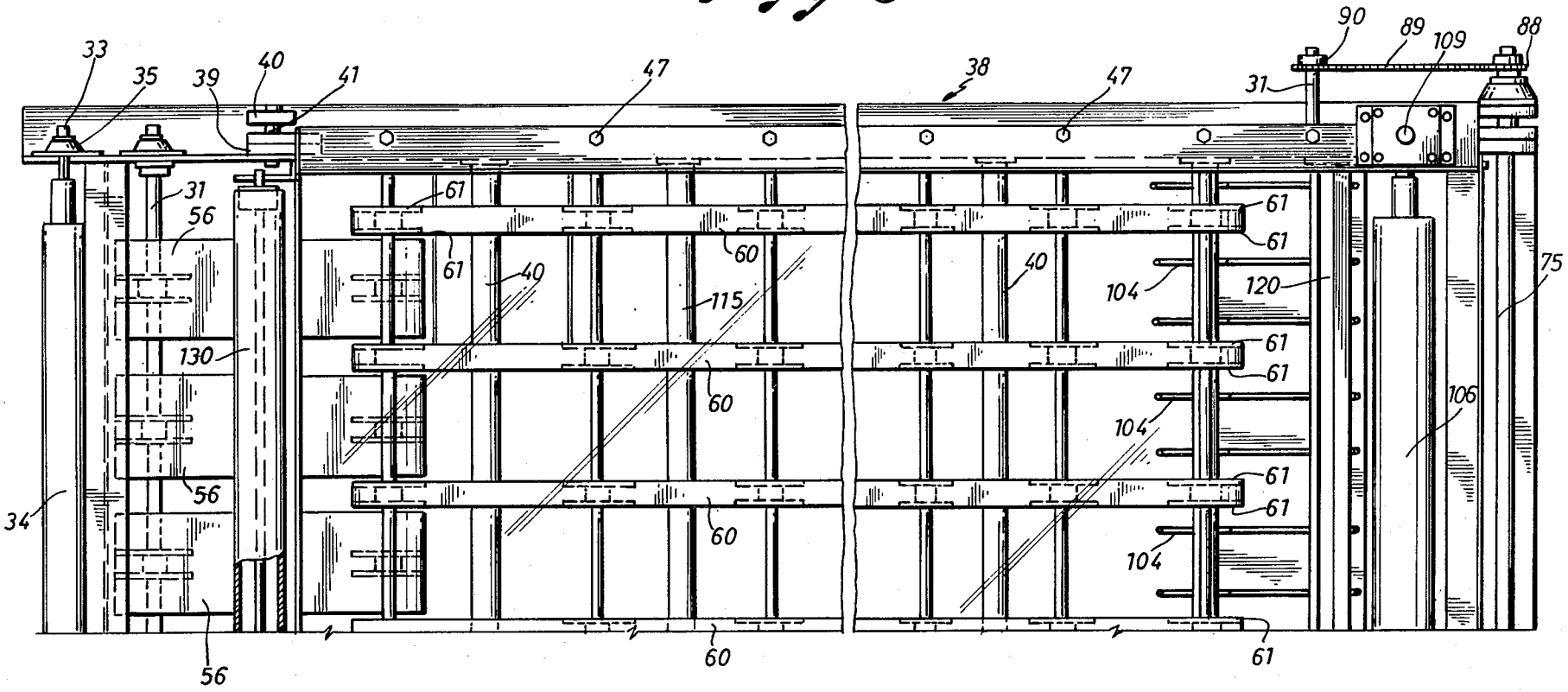
FIG. 3 is a view similar to FIG. 2 but taken along lines 3—3 of FIG. 1 and showing the endless belt arrangement that forms the upper drive of the conveyor means.

The upper conveyor assembly as shown in FIG. 3 is similar in arrangement and construction to the lower assembly described above, however it is preferred that these link belts 60 be relatively long and extend throughout the length of the upper conveyor bed. The belts 60 pass around laterally spaced pairs of sprocket wheels 61 on the first and last of the shafts 45, and may pass over toothless idler wheels on the intermediate ones of the shafts 45. In any event, the belts 60, sprocket wheels 61 and shafts 45 are all commonly driven as will be described below.

Figure 4:
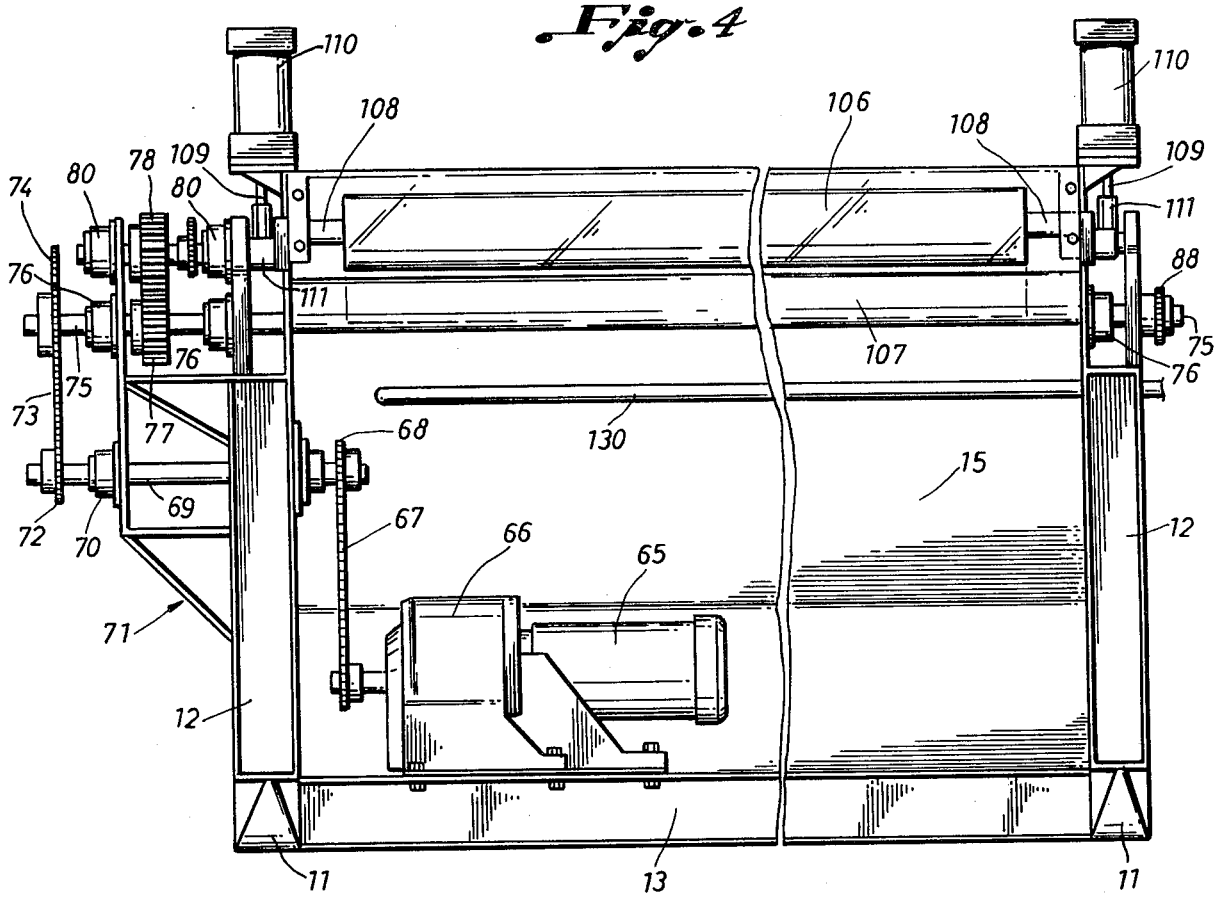
FIG. 4 is an end view of the apparatus shown in FIG. 1.

In order to drive the individual belts so as to transport a mat through the machine, a motor 65 and a gear box 66 are mounted to the frame assembly at the rear of the machine as shown in FIG. 4. The motor 65 may be a typical reversible electric device that is operated through suitable remote controls (not shown). The output of the gear box 66 is coupled by a chain 67 to a sprocket 68 on the inner end of the stub shaft 69 which is mounted by bearings 70 to the frame member 12 and a mounting bracket 71 which is secured by welding thereto. The outer end of the shaft 69 carries a sprocket 72 which drives chain 73 extending around another sprocket 74 on the outer end of a drive shaft 75. The drive shaft 75 is mounted in a bearing 76 and has a spur gear 77 keyed thereto which meshes with another spur gear 78 carried on a stub shaft 79 mounted by bearings 80 on the bracket assembly 71. To the side of the spur gear 78 a sprocket 81 is keyed to the shaft and drives another chain 82 (FIG. 2) which, in turn, drives a sprocket 83 on the outer end of the shaft 84 of one of the extract rollers at the discharge end of the machine. A drive chain 85 extends around another sprocket 86 that is keyed to the end of one of the transverse shafts 45 of the upper conveyor belt assembly as shown in FIG. 1, to provide a driving connection thereto, whereby operation of the motor will drive all of the upper drive belts 60 simultaneously. The long drive shaft 75 extends to the opposite side of the machine as shown FIG. 4 where it is mounted in a bearing 76 and keyed to a sprocket 88 that is connected by a chain 89 to a sprocket 90 that is keyed to the end shaft 31 of the lower conveyor belt drive assembly as shown in FIG. 3. The driving of this shaft 31 will cause all of the belts 57 of the lower conveyor assembly to be simultaneously driven via the shafts and sprocket wheels as previously described. Thus the motor 65 provides by means of driving the various sprockets, gears and chains in a synchronous manner for both the upper and lower conveyor belt assemblies, with the individual link belts being internally driven by the arrangement of sprocket wheels and the belts themselves. A suitable control panel (not shown) is provided at the entrance end of the machine so that an operator can start and stop the conveyor system as well as reverse the direction thereof, as desired.

Figure 6:
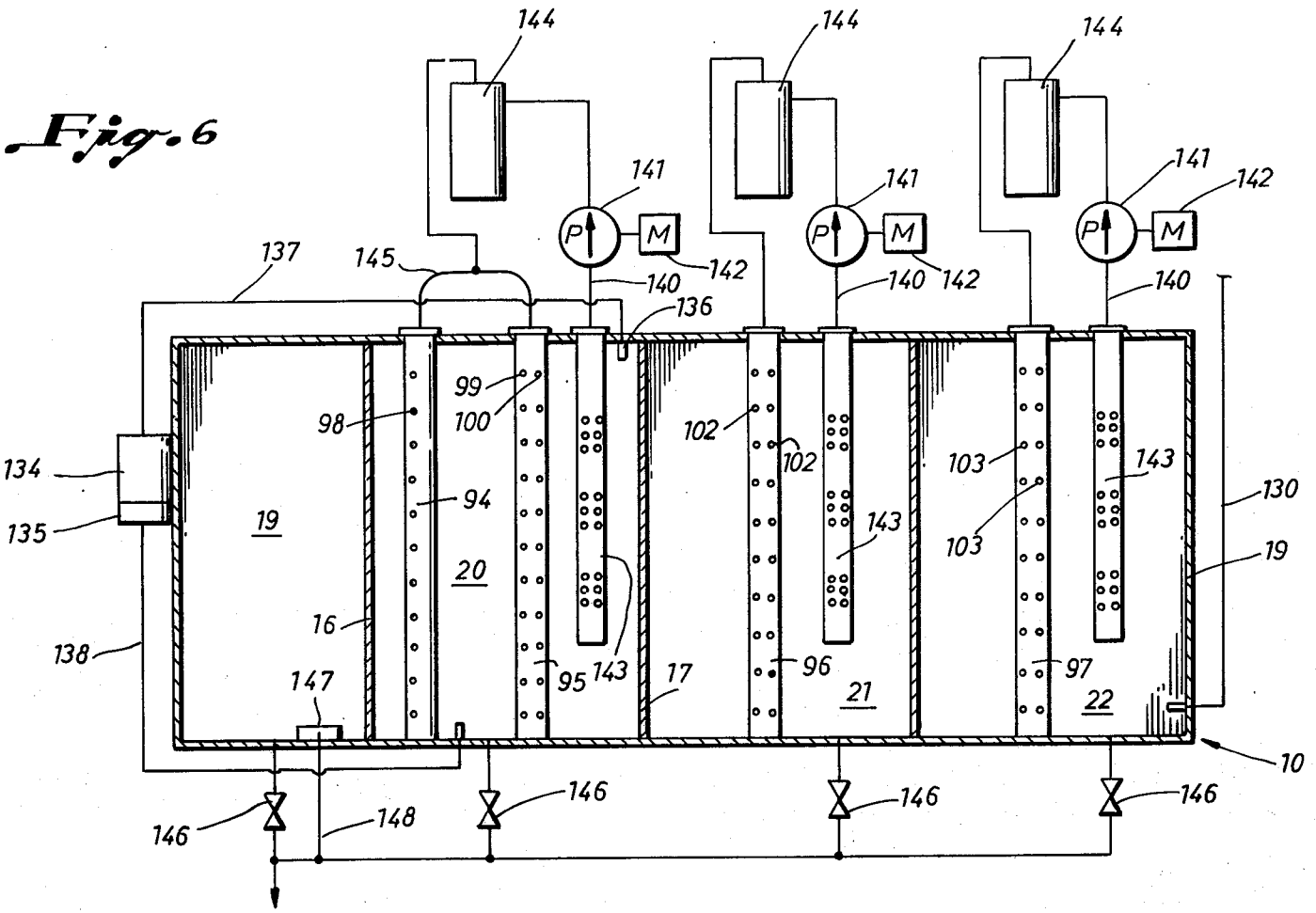
FIG. 6 is a schematic top view of the tank assembly showing the suction pump and sand separator components used in recirculating detergent and rinse liquid to the various tank sections of the machine.

To provide the mat washing and rinsing action in accordance with the present invention, a series of header pipes 94–97 are positioned to extend transversely between the side walls of the tank assembly 10 adjacent the upper edges thereof as shown in FIGS. 1 and 6. The first header pipe 94 is provided with a row of spray nozzles 98 which direct relatively flat sprays of a detergent and water solution upwardly at an angle against the nap of the mat. The angle of the sprays emanating from the nozzles 98 with respect to horizontal is in the range of from 30° to 40°, and preferably is 35°. Thus the sprays impinge against the sides of the nap and provide an effective deep cleaning and washing action, and the wash water containing heavy and light solids falls into the first tank section 19. The second header pipe 95 is provided with two rows of nozzles 99 and 100, with these rows of nozzles also providing flat or knife-like sprays. The nozzles 99 are directed toward the front of the machine, and the other row of nozzles 100 providing similar flat sprays directed rearwardly. A splash shield 101 is mounted in the manner shown to prevent liquid deflected off of the bottom of the mat from interrupting the sprays coming from the nozzles 98 on the header pipe 94. Since the nap of the mat is subjected to water sprays from the front and the rear, the nap is in effect "turned" as it is conveyed past these headers to provide a thorough cleaning action. Of course the washing liquid from the header 95 falls after impingement on the nap into the second detergent tank section 20.

The other two headers 96 and 97 are each provided with two rows of spray nozzles 102 and 103 which direct sprays of water in the forward and rearward directions, as shown, at angles of 35° against the nap to provide a rinse action. The water after impinging on the nap falls into the first and final rinse tank sections 21 and 22, respectively. The spray nozzles 102 and 103 preferably provide somewhat diverging spray patterns as opposed to the "knife-type" action of the wash section nozzles 98–100. Also it is preferred that the working pressure of the sprays in the wash sections be in the order of 160 psi, while the working pressure of the sprays in the rinse sections is about 80 psi. The broader impact area of the rinse sprays provides a flushing action to remove any further particulates that might remain in the nap of the mat at this time.

After the mat passes over the final rinse tank section 22, it is elevated slightly by a plurality of longitudinally extending pick rods 104 and 105 as shown in FIG. 5 before it goes in between the upper and lower extract rollers 106 and 107. The slight elevation of the mat at this point serves as an aid to water removal. The pick rods 104 may be mounted in any suitable manner, such as on the lower edges of struts that are fixed to a tubing member 120 that extends transversely between the inner side walls of the upper conveyor frame members. The lower pick rods 105 may be mounted in a similar manner on struts that are fixed to a conduit 122.

The upper extract roller 106 preferably is made of a plated steel, while the bottom roller 107 is made of rubber having a 90 durometer hardness. The ends of the shaft 108 which carries the upper roller 106 are pressed downwardly by piston rods 109 that extend from air cylinders 110 mounted to the upper side of the frame members 37. The lower ends of the rods 109 are connected to the bearings assemblies 111 which are slidably mounted for vertical movement as shown in FIG. 5, whereby air pressure supplied to the cylinders by a suitable compressor forces the extract rollers relatively toward one another in order to pull the mat from the machine and to squeeze moisture that may remain therein. In practice the air cylinders have a 4 inch diameter, and an air pressure of about 90 psi has been found to be suitable.

The vinyl backing of the mat may be cleaned by spray headers 115 shown in FIG. 1 that also function as spacer tubes for the side members 37 of the top conveyor assembly 38. Detergent and rinse solutions are fed in through pipe connections (not shown) on the respective ends of each of the tubes, and pass through rows of laterally spaced nozzles 116 where they inpinge on the back of the mat. As shown in FIG. 1, the nozzles 116 are angled forward for best results.

An optional feature of the present invention is the provision of upper and lower "air-knives" which are located immediately in front of the extract rollers as shown in FIG. 5. The air-knives function to remove any excess moisture from the mat as it leaves the machine. As shown in the drawing, the upper air-knife includes the transverse conduit 120 having its ends attached by flanges to the side walls of the members 37 with the interior thereof being supplied with air under pressure from a suitable source. Streams of air emanating from nozzles 121 that are attached to the conduit 120 impinge on the back of the mat as shown. Another transverse conduit 122 that is mounted in a manner similar to the conduit 120 is supplied with air under pressure that psses out through nozzles 123 and impinge against the nap of the mat. The orifices of the respective nozzles 121, 123 are shaped to form flat streams of air having high velocity to remove moisture as will be apparent to those skilled in the art. The nozzles on the respective air headers are directed at an angle toward the front of the machine.

For the first two detergent tank sections 19 and 20, which are joined together by the opening 25, there is provided as shown schematically in FIG. 6 a suction line 140 connected to a filter pipe 143 which extends into the tank section 20 below the level of the spray headers 94 and 95. The line 140 leads to the inlet of a centrifugal pump 141 that is driven by a motor 142. The filter pipe 143 has elongated slots formed therein, and preferably is covered by wire mesh to prevent entry of sediments. The large size of he slots prevent eddies from forming within the tank. The pump 141 supplies the liquid under pressure to a conventional sand separator 144 which operates to remove solid particles that may remain in the water down to a very small size. The water coming from the sand separator 144 is supplied via an inlet manifold 145 to the headers 94 and 95 having the spray nozzles 98–100 as previously described. In an arrangement similar to that described above, each of the rinse tanks 21 and 22 also is provided with a suction filter pipe, pump and motor, and a sand separator to remove particles and recirculate the water to the rinse tank header pipes. Since these elements are identical to those previously described, they have been given the same reference characters in FIG. 6. Water under pressure from the separators also is fed to the upper headers 115 which direct wash and rinse water against the back of the mat to clean the same. On the opposite side of each tank section 19–22, at the bottom edge thereof, outlet connections are provided with valves 146 connected to a drain manifold 147 to facilitate cleaning the tank sections of sediments.

Process water is continuously fed into the final rinse tank 22 via a line 130 at a relatively low rate. Water from this tank flows into the first rinse tank 21 over the top of partition 18, and then flows into the detergent tank sections 19 and 20 over the top of partition 17, the partitions having gradually diminishing heights to produce a weir dam effect as previously described. From the detergent tank 19 the liquid is drained via a weir box 147 to the drain line. The weir box skims any sludge that may form on the surface of the liquid in the tank sections 19 and 20.

A desired amount of detergent is fed into first and second detergent tanks 19 and 20 from a soap drum 134 by a chemical injector 135 under control of a probe 136 connected by a line 137. Detergent is fed through a line 138 so as to maintain a preselected ph level of about 7.3. The detergent preferably is formulated as a solution of a defoamer and degreaser suitable for mat washing.

OPERATION

In operation mats that are to be cleaned are fed by an operator into the conveyor system over the feed roller 34 and onto the wide belts 56 with the nap of each mat facing downward. A safety roller 130 with suitable switch means may be provided to shut off power to the drive motor 65 in the event the hands of the operator should be inadvertently extended into the conveyor system. Each mat enters in between the upper belts 60 and the lower belts 57 and is conveyed thereby over the sequence of tanks 19–22. Sprays of detergent liquid formed by the nozzles 98 and 99 on the respective transverse header pipes 94 and 95 are directed upwardly in planes having an angle with respect to the horizontal path of travel of the mats of about 35°, and thus impinge against the sides of the nap to provide a scrubbing action. The third row of nozzles 100 on the header pipe 95 are directed at an angle of 35° toward the rear of the machine, and thus provide detergent sprays that turn the nap as it passes over this point of impact. The nozzles 98, 99 and 100 all have orifices suitably formed to provide relatively flat or knife-like sprays which provide a very effective cleaning action. The spray shield 101 prevents detergent deflected off the nap from interrupting the spray pattern from the nozzles 98. Detergent and particulate matter falls into the first two tank sections 19 and 20 which are connected together by the wall opening 25 for sediment settling.

After passing over the washing or scrubbing sections f19 and 20 of the tanks, the mat then is conveyed over the rinse sections 21 and 22 thereof. Here the nap is subjected to water sprays from nozzles 102 and 103 on the respective header pipes 96 and 97, with the respective rows of nozzles on each header pipe being directed at 35° angles toward the front and rear. The orifices of the nozzles 102 and 103 are designed to provide diverging spray patterns that flood the nap and flush out any detergent and sand or dirt particles or other impurities that may still remain therein. After impinging on the nap the liquid from the nozzles 102 and 103 falls into the rinse tank sections 21 and 22.

As the leading edge of each mat approaches the extract rollers 106 and 107 at the exit end of the machine, it passes in between the upper and lower pick rods 104 and 105. The lower rods 105 function to lift the edges somewhat to drain the rug of excess water and to guide the mat in between the extract rollers. The rollers 106 and 107 are pressed toward one another by the pneumatic cylinders 110, and thus function to pull the mat along as well as to remove excess moisture that remain therein. The air streams from the nozzles 121 and 123 on the headers 120 and 122 impinge on the respective back and front surfaces of the mat to provide additional moisture removal prior to passage of the mat through the rollers.

The motor 65 and the various drive trains including the chains and sprockets as described above, drive the upper and lower conveyor belts assemblies simultaneously. The staggered array of lower drive belts 57 are all geared together by the sprocket wheel and shaft arrangement, as are the wider entry belts 56. The upper conveyor belts 60 also are provided with a common drive, so that the entire conveyor system is operated smoothly and continuously for feeding mats through the machine in a smooth and efficient manner. The support cables 58 prevent any edges of the mat from hanging up in the machine or otherwise impeding feed-through.

The heavier particles and impurities cleaned from the mat are permitted to settle out in the detergent tank sections 19 and 20 which are connected by the open area 25. Water from these sections is circulated via the filter tubes 143 to the inlet of the pump 141 which supplies the same under pressure to the sand separator 144 which removes additional small particles that may remain. The relatively clean water coming out of the separator is resupplied to the header pipes 94 and 95 in a continuous circulation manner. Similar combinations of filter tube, pump and sand separators are employed in recirculating the rinse water in the tank sections 21 and 22. Detergent is injected into the tanks sections 19 and 20 are previously described to maintain the desired ph level. Since the washing and rinsing liquids are recirculated relatively free of solids, very little feed or process water is required in the operation of the machine. Whereas other machines on the market have used as high as 50–60 gpm process water, the machine according to the present invention may use as low as 12–13 gpm feed water in processing two to three times more mats per hour than such prior machines.

It now will be recognized that a new and improved mat or industrial rug washing apparatus has been disclosed. The apparatus employs high velocity liquid sprays that are directed at particular angles against the nap of the mat to provide effective scrubbing and rinsing action. The conveyor system for feeding mats through the machine is internally driven and operates smoothly and without appreciable drag to provide a high capacity operation. The machine is constructed and arranged to be susceptible of easy maintenance as required.

Since various changes or modifications may be made in the disclosed embodiment of the present invention without departing from the inventive concepts involved, it is the aim of the appended claims to cover all such changes and modifications falling within the true spirit and scope of the present invention.

What is claimed is:

1. A washing machine for use in cleaning mats or the like of the type having nap on one side, comprising: tank means having spaced side walls and front and rear end walls; conveyor means mounted on said tank means for moving a mat in a substantially horizontal plane along the top of said tank means with the nap of said mat facing down, said conveyor means having an entrance adjacent the forward end of said tank means and an exit adjacent the rearward end thereof; transverse header means extending between said side walls below said conveyor means; a first row of nozzles on said header means for directing substantially flat sprays of a washing liquid in an upward and forward direction whereby said sprays impinge against the sides of said nap at an angle with respect to the horizontal path of travel of said mat that is in the range of from 30° to 40°; and a second row of nozzles on said header means for directing substantially flat sprays of a washing liquid in an upward and rearward direction whereby said sprays impinge against the opposite sides of said nap at an angle with respect to the horizontal path of travel of said mat that also is in the range of 30° to 40°, the impingement of said sprays on the opposite sides of said nap functioning to turn said nap as the mat is conveyed over said header means to provide a thorough cleaning action.

2. The machine of claim 1 wherein said angle is 35°.

3. The machine of claim 1 wherein said conveyor means comprises upper and lower conveyor assemblies, each of said assemblies having a plurality of endless drive belts that extend around sprocket wheels which are fixed on transverse shafts, and further including means for commonly driving all of said belts to convey a mat therebetween along the top of said tank.

4. The machine of claim 3 wherein said drive belts on said lower assembly are arranged in a staggered array to permit said sprays to impinge freely on said nap.

5. The machine of claim 4 wherein a pair of extract rollers are mounted at the exit end of said conveyor means, and further including means for forcing said rollers relatively toward one another, said extract rollers being driven commonly with said drive belts.

6. The machine of claim 5 further including means for elevating a mat above the plane of the top courses of said lower drive belts prior to the entry of said mat between said extract rollers.

7. The machine of claim 5 further including air knife means located immediately ahead of said extract rollers for removing excess moisture from said mat.

8. The machine of claim 4 further including a plurality of guide rods or cables extending throughout substantially the entire length of said lower conveyor assembly in between the drive belts thereon for preventing edges of a mat being conveyed thereby from hanging up in the conveyor means.

9. The machine of claim 1 further including spray means for directing additional sprays of a washing liquid against the top side of a mat being moved along the top of said tank by said conveyor means.

10. The machine of claim 1 wherein said conveyor means is provided with a top cover comprising a sheet of transparent plastic to permit a machine operator to view the progress of the mat through the conveyor means.

11. The machine of claim 1 further including pump means for removing washing liquid from said tank and supplying the same under pressure to a sand separator means which removes small particles from the liquid, said liquid then being fed to said spray means in a substantially continuous circulation system.

12. A machine for use in washing mats or the like having nap on one side, comprising: tank means having spaced side walls, forward and rearward end walls and internal partition walls extending between said side walls for dividing said tank means into at least one wash section and at least one rinse section; conveyor means mounted on the top of said tank means for moving a mat in a substantially horizontal plane therealong with the nap of said mat facing downward, said conveyor means having entrance and exit ends adjacent the respective forward and rearward end walls of said tank means; first spray means associated with said wash section for directing relatively flat sprays of a detergent liquid upwardly at an angle against said nap; and second spray means associated with said rinse section for directing diverging sprays of rinsing liquid upwardly at an angle against said nap; each of said spray means comprising a transverse header pipe extending between the side walls of said tank means below said conveyor means, each of said header pipes carrying first and second rows of nozzles with said first row of nozzles being inclined upwardly and forwardly so as to cause sprays emanating therefrom to impinge against the sides of said nap at an angle with respect to the horizontal path of travel of said mat that is in the range of from 30° to 40°, said second row of nozzles being inclined upwardly and rearwardly so as to cause sprays emanating thereform to impinge against the opposite sides of said nap at an angle with respect to the horizontal path of travel of said mat that is in the range of from 30° to 40°, the impingement of said sprays on the opposite sides of said nap functioning to turn said nap as the mat is conveyed over said spray means to provide a thorough cleaning and rinsing action.

13. The machine of claim 12 wherein said angles are 35°.

14. The machine of claim 12 wherein said conveyor means comprises an upper conveyor assembly and a lower conveyor assembly, each conveyor assembly having a plurality of longitudinally extending endless drive belts that extend around sprocket wheels having teeth that engage lugs on the inner peripheries of said belts, said sprocket wheels being fixed on transverse shafts mounted on said conveyor assemblies; and further including motor and drive means for commonly driving all of said belts to convey a mat therebetween along the top of said tank.

15. The machine of claim 14 wherein said drive belts on said lower assembly are arranged in a staggered array to permit said sprays of detergent liquid and rinsing liquid to impinge freely on said nap.

16. The machine of claim 15 further including a plurality of guide cables extending parallel to said belts on said lower assembly and to the side thereof for preventing the edges of a mat being conveyed thereby from hanging in said conveyor means.

17. The machine of claim 16 wherein a pair of vertically spaced extract rollers are mounted at the exit end of said conveyor means, and further including means for forcing said rollers relatively toward one another, said extract rollers being driven commonly with said drive belts.

18. The machine of claim 17 further including a plurality of pick rods for elevating a mat above the plane of the top run of said lower drive belts prior to the entry of said mat between said extract rollers.

19. The machine of claim 18 further including air knife means located immediately ahead of said extract rollers for removing excess moisture remaining in said mat.

20. The machine of claim 12 further including spray means for directing additional sprays of a washing liquid against the top side of a mat being moved along the top of said tank by said conveyor means.

21. The machine of claim 12 wherein said conveyor means is provided with a removable top cover comprising a sheet of transparent plastic to permit visual observation or the progress of a mat through said machine.

22. The machine of claim 12 further including pump and desander means associated with each of said wash and rinse sections for taking liquid therefrom, removing particles from the liquid and then resupplying the liquid to the respective first and second spray means.

23. The machine of claim 22 further including means for injecting detergent into said wash section or said tank means to maintain a predetermined ph level therein.

* * * * *